United States Patent [19]

Bloomer

[11] 3,934,495

[45] Jan. 27, 1976

[54] PAINT SPRAYING BOOTHS

[75] Inventor: Ivan Bloomer, London, England

[73] Assignee: Carrier Drysys, Ltd., London, England

[22] Filed: Jan. 16, 1974

[21] Appl. No.: 433,778

[30] Foreign Application Priority Data

| | | |
|---|---|---|
| Jan. 22, 1973 | United Kingdom | 3095/73 |
| Mar. 5, 1973 | United Kingdom | 10650/73 |
| July 24, 1973 | United Kingdom | 35239/73 |

[52] U.S. Cl. ..... 98/115 SB; 55/223; 118/326; 98/115 R

[51] Int. Cl.[2] ..... F23J 11/00

[58] Field of Search ..... 98/115, 115 SB; 118/326; 55/223, 228, 248, 260, 462, 465

[56] References Cited

UNITED STATES PATENTS

| | | | |
|---|---|---|---|
| 3,138,087 | 6/1964 | Larsson | 98/115 SB |
| 3,421,293 | 1/1969 | Halls | 98/115 SB |
| 3,750,375 | 8/1973 | Wintrell | 55/223 |
| 3,795,093 | 3/1974 | Gerhard | 98/115 SB |

*Primary Examiner*—William E. Wayner
*Assistant Examiner*—Henry C. Yuen
*Attorney, Agent, or Firm*—Snyder, Brown and Ramik

[57] ABSTRACT

Paint-laden air extracted from a paint-spraying booth is scrubbed by passing the paint-laden air together with a flow of water through at least one tube which extends downwards from the floor of the booth to a position spaced from the bottom of a water-container. A perforated baffle is located between the bottom of the water-container an an air velocity control opening associated with the tube, or one with each tube, the opening being of lesser cross-section than the tube and the perforations small as compared with the opening. A first stage separation of paint from air is effected by impingement against the baffle, a second stage by impingement of paint-laden air which passes through the perforations against water on the bottom of the water-container, and a third stage by passage of air through an annular curtain of water formed between the control opening and the surface of water in the water-container.

8 Claims, 12 Drawing Figures

6
12
5
11
1
10
12
11
II
4
3
2
9
7
11
8
14
II
9
11
12
11
5
1
11
10

17
3
2
4
30
14
24
19
24
19
16
15
23
22
21
6

FIG. 2.
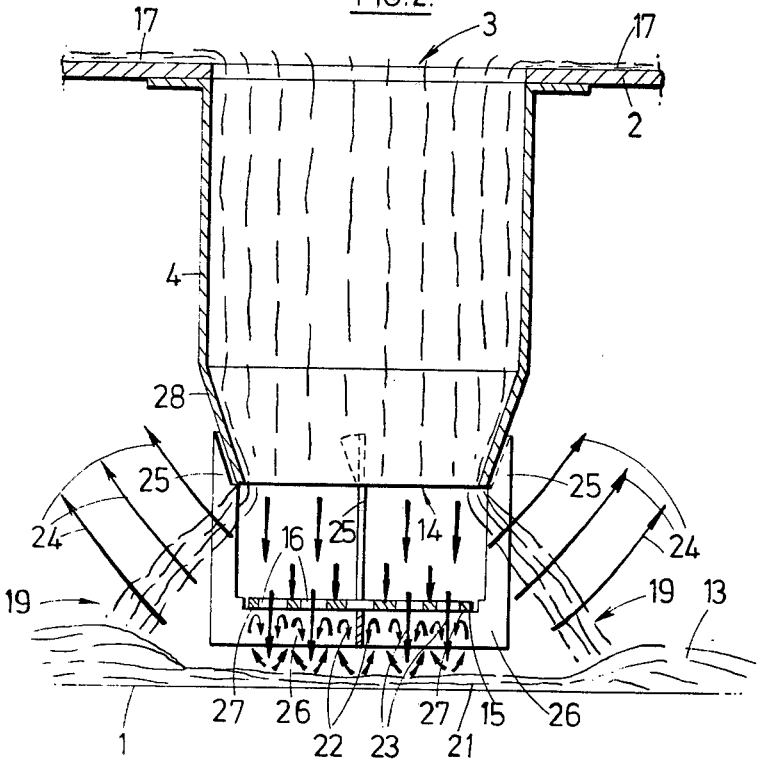
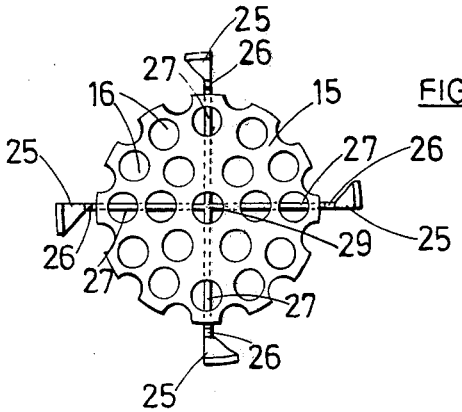
FIG 3

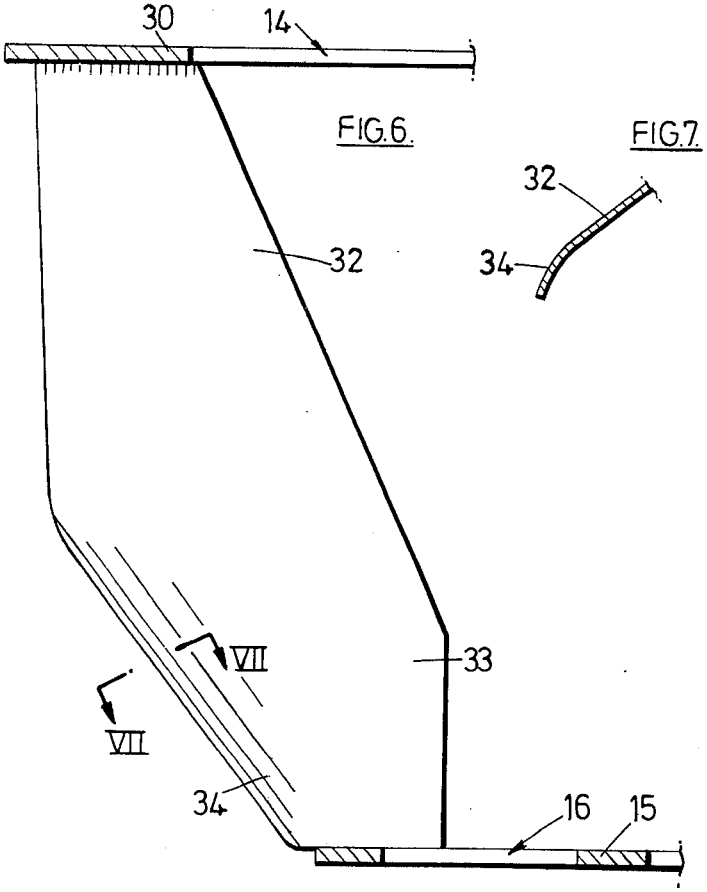
FIG.6.
FIG.7.
FIG.8.
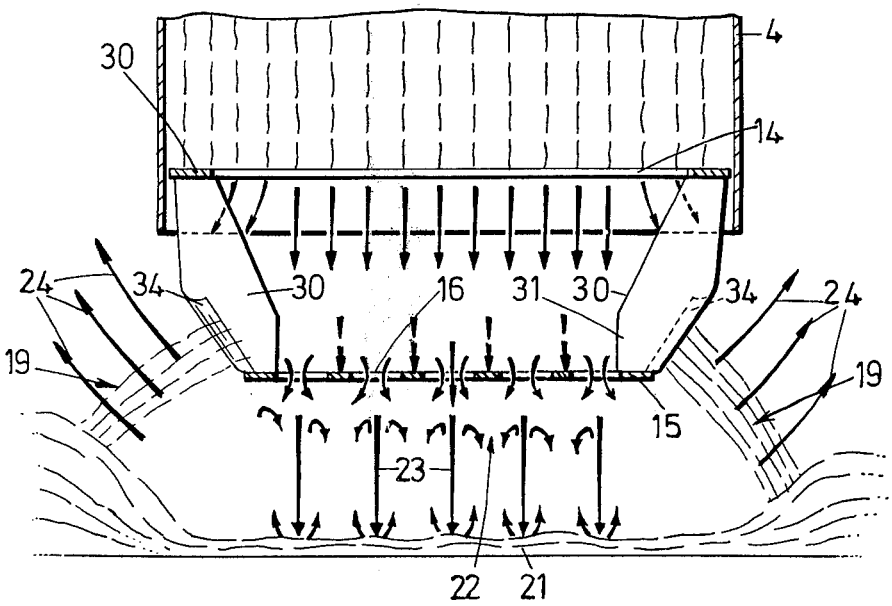

PAINT SPRAYING BOOTHS

BACKGROUND OF THE INVENTION

1. Field of the Invention

This invention relates to booths in which paint is sprayed on to articles to be coated and in particular is concerned with apparatus for scrubbing paint-laden air extracted from such booths.

2. Description of the Prior Art

In U.S. Pat. No. 3,421,293, granted Jan. 14, 1969 there is described a paint-spraying booth which comprises a water-containing trough located beneath and spaced from the floor of the booth, air-extractor means connected with air exhaust ducts which extend lengthwise of and beneath the floor of the booth, at least one tube which extends downwardly from the floor and has the lower end thereof disposed above and spaced from the level of water in the trough, and means arranged to cause a flow of water over the floor and into the tube or tubes. In this arrangement the interior of the tube is provided with vanes arranged to create in air and water passing through the tube a gyratory turbulence which forms the water into small droplets to which at least some of the paint entrained in the air adheres. This arrangement has been found in practice to give very satisfactory scrubbing but the construction of the vanes must be very precise.

It has also been proposed to effect scrubbing of paint-laden air by causing the extractor means to draw the paint-laden air through one or more curtains of water but, as is well understood, water curtains are notoriously difficult to maintain in a continuous state and scrubbing efficiency falls rapidly where there is discontinuity of the curtain or curtains.

It is an object of the invention to provide an improved form of the apparatus first referred to above whereby by the use of a simple construction it is possible to reduce maintenance cleaning to a minimum, to reduce to a minimum the use of water curtains for scrubbing, to provide precise control of operating efficiency to an extent which makes it possible to obtain a more efficient scrubbing than has hitherto been possible, and to provide an apparatus which is capable of scrubbing very small solids particles, for example particles having a size of less than $5\mu$, without the use of increased power.

SUMMARY

According to the invention there is provided in a paint-spraying booth apparatus for scrubbing paint-laden air, which apparatus comprises a water-container located beneath and spaced from the floor of the booth, air extractor means connected with exhaust ducts which extend lengthwise of and beneath the floor of the booth, at least one tube which extends downwardly from the floor and has the end thereof nearest the bottom of the water-container disposed above and spaced from the level of water in the water-container, and means arranged to cause a flow of water over the floor and into said tube or tubes, wherein between the end of the tube, or of each tube, nearest the bottom of the water-container there is located a perforated baffle provided with a plurality of perforations, said baffle being spaced from the bottom of the water-container and from an air velocity control opening of lesser cross-section than that of the tube associated with said end of the tube and co-axial therewith and with the baffle, said perforations being small as compared with said opening, the arrangement being such that in use of the apparatus the baffle provides by impingement thereon a first stage separation of paint particles from entraining air, water on the bottom of the water-container immediately below the baffle provides, by impingement thereon of paint entraining air which passes through the baffle perforations, a second stage separation, and an annular curtain of water formed between said control opening and the surface of water in the water-container provides a third stage separation by the passage of paint entraining air therethrough.

BRIEF DESCRIPTION OF THE DRAWINGS

FIG. 2 is a section on line II—II, FIG. 1, and illustrates a tube and baffle as employed in the apparatus of FIG. 1, FIg. 3 is a plan of a part of FIG. 2, FIG. 6 illustrates, to an enlarged scale, one of a number of vanes associated with the tube and baffle of FIG. 4, FIG. 7 is a section on line VII—VII, FIG. 6, FIG. 8 diagrammatically illustrates the mode of operation of the apparatus of FIG. 4.

In the drawings like or similar parts will be indicated by like reference numerals.

DESCRIPTION OF THE PREFERRED EMBODIMENTS

Figure 1:
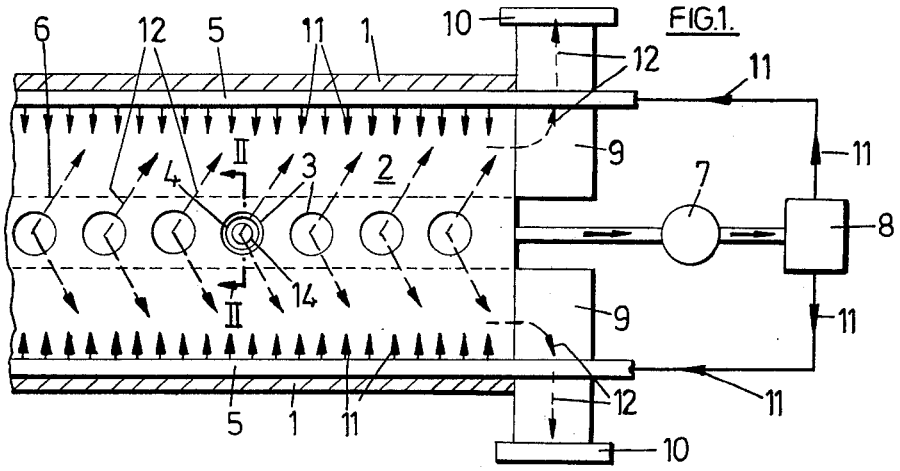
FIG. 1 is a diagrammatic plan of a paint-spraying booth provided with apparatus according to the invention.
Figure 12:
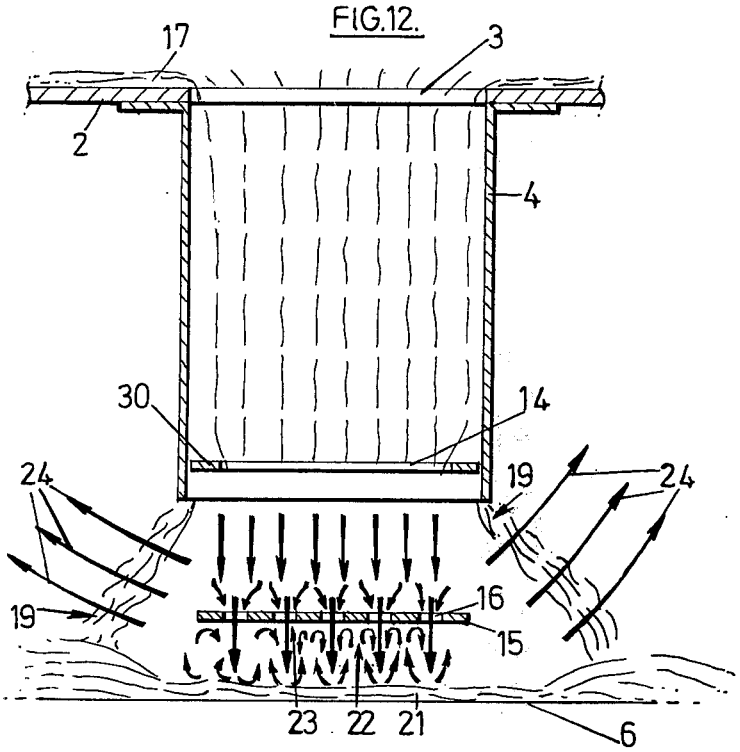
FIG. 12 illustrates the mode of operation of the apparatus of FIGS. 9 to 11.
Figure 4:
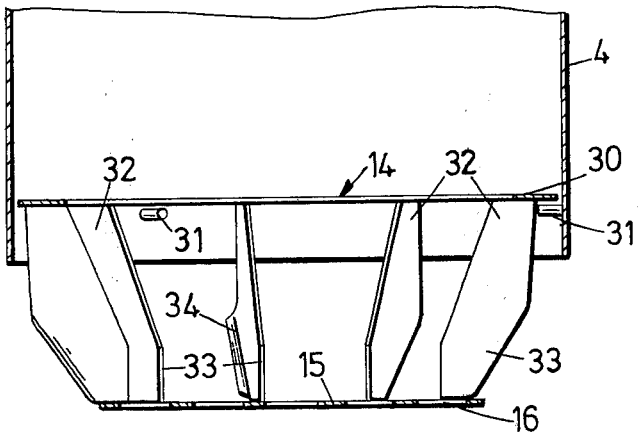
FIG. 4 is a section similar to that of FIG. 1 but illustrates an alternative form of tube and baffle.
Figure 5:
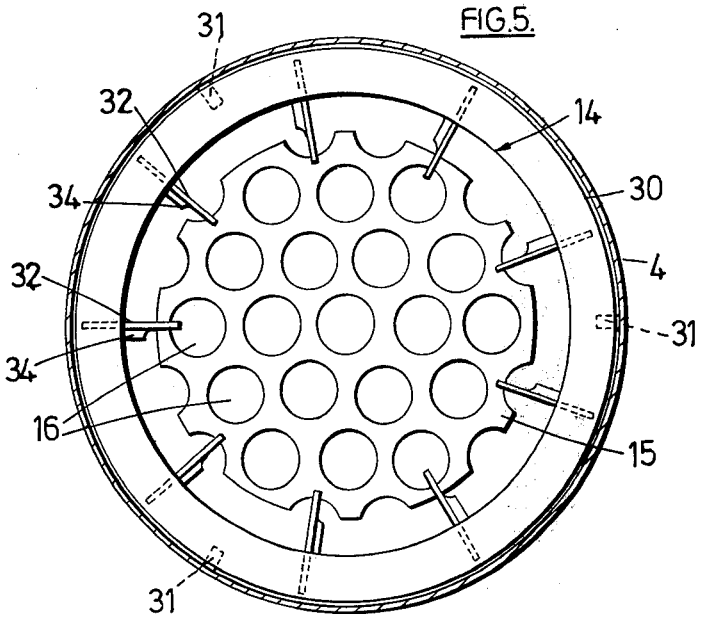
FIG. 5 is a top plan of FIG. 4.

Referring to the drawings, FIG. 1 diagrammatically illustrates a paint-spraying booth which includes side walls 1, and end walls and a roof not shown, and has a floor 2 which extends lengthwise of the booth and may, although not illustrated, slope downwards from the opposite sides 1 towards the centre. Circular openings 3 in the middle of the floor are spaced apart lengthwise of the booth and communicate with tubes 4 which are supported to extend downwards from beneath the floor. The tubes 4, which may be of circular, rectangular, elliptical or polygonal crosssection, form part of a water-circulating system the water in which may be chemically treated to assist the adherence of paint particles to water droplets and the subsequent cleansing of the water. The said system includes pipes 5 located on the top of the floor, a water-container 6 which extends lengthwise of the booth and into which the tubes 4 depend, a circulating pump 7 and water-cleansing means 8, of any suitable known kind.

The water-container 6 communicates with air exhaust ducts 9 which also extend lengthwise of the booth and which are located beneath the floor. The ducts 9 at one end thereof are each connected with an air extraction means 10, for example fans, which extract air from the booth through the tubes 4. In operation, water is circulated round the water-circulating system by the pump 7, as indicated by the arrows 11 and flows over the floor into the tubes 4. Air is drawn, as indicated by the arrows 12, from the booth into the tubes 4, and is exhausted through the ducts 9.

Referring to FIG. 2 the lower end of each tube 4 is disposed above and is spaced from the level 13 of water in the water-container 6 and has at or near its lower end an air flow-constricting opening 14 which is of lesser cross-section than that of the interior of the tube. Between the opening 14 and the bottom of the water-container there is located a perforated baffle 15, the shape of which corresponds to the cross-section of the tube 4. The baffle 15 has a plurality of perforations 16 each of which is small as compared with the opening 14. The opening 14, the baffle 15, and the bottom of the water-container are so spaced axially relative one to the other that when paint entrained in air is drawn through the tube by the extractor means with concomittant flow of water 17 through the tube, paint entrained in air and some of the paint adhering to water droplets impinges against the baffle 15 and some passes through the perforations 16 and impinges against the water layer 21 on the bottom of the water-container and there is formed between the opening 3 and the surface of water in the water-container an annular curtain 19 through which air is drawn, as indicated by the arrows 24, by the extractor means into the exhaust ducts 9. The zone beneath the perforated baffle 15 is not swept clear of water as would be the case if the baffle were not present and so a layer 21 of water is retained beneath the baffle on the bottom of the water-container. As can be seen from FIG. 2, the perforated baffle 15 provides a number of recirculatory volumes 22 beneath the baffle between columns 23 of air/paint/water mixture formed in passing through the perforations 16. The solid portions of the baffle 15 form impact surfaces which provide a first stage separation of paint particles from the air, and a second stage separation is provided by the passage of paint particles entrained in air and paint adhering to water droplets through the perforations 16 and the impingement thereof against the water layer 21 on the bottom of the water-container. A third stage separation is provided by forming between the opening 14 and the surface of the water in the water-container the annular curtain 19 of water through which air, as indicated by the arrows 24, is drawn by the extractor means into the exhaust ducts 9. Very fine paint particles entrained in air passing through the curtain 19 are washed from the air by the water curtain.

In the embodiment illustrated in FIGS. 2 and 3 the perforated baffle 15 rests on a spider having vertically disposed legs 25 and horizontally disposed arms 26 provided with cut-out portions 27 on which the baffle rests. The opening 14 is formed by the smaller end of a frusto-conical member 28 which is a continuation of the tube 4. The member 28 may, as illustrated in FIG. 2, be integral with the tube 4 or it may be a separate member secured to the tube 4 in which case it can be separable from the tube so that members 28 having openings 14 of differing sizes can be selectively secured to the tube.

In a preferred form thereof the spider is formed in two parts each of which consists of two legs 25 and two arms 26 which are at right-angles one to the other. The two parts are welded, or otherwise secured one to the other, at the junction of the angles as indicated at 29, FIG. 3.

In the embodiment illustrated in FIGS. 4 to 8 the control opening 14 is formed by an annular plate 30 which rests on projections 31 extending into the tube 4 and the perforated baffle 15 is connected to the plate 30 by a plurality of vanes 32 which are equi-spaced around the plate. The vanes are secured to the plate 30 and baffle 15 in any desired manner, for example by welding. The lower ends of the vanes 32 are formed by portions 33 which are substantially perpendicular to and are secured to the baffle 15.

Each vane 32 has a downwardly extending portion 34 which is of arcuate form, FIG. 7, directed outwardly from the vane. The portions 34 of the vanes impart to the air/paint mixture a swirling action which results in highly atomised droplets of water which are thrown outwards to form the curtain 19.

Referring to FIG. 8, the air, water, and paint which impacts against the baffle 15 does so, as is the case in each embodiment, at a high velocity, for example a velocity of about 7000 feet per minute. In the embodiment of FIG. 8, air which impacts against the baffle 15 changes direction to one which initially is substantially along the plane of the upper face of the baffle 15 and has an initial velocity which is substantially the same as the velocity before impact. This causes atomisation of the water into droplets which form the curtain 19 together with the atomised droplets formed by the swirling action of the arcuate portions 34 of the vanes 32. Below the baffle 15 atomisation caused by impact of the water against the water layer 21 creates the recirculatory volumes 22.

The plate 30 and baffle 15 can be readily removed from the tube 4 as a unit for servicing.

Figure 9:
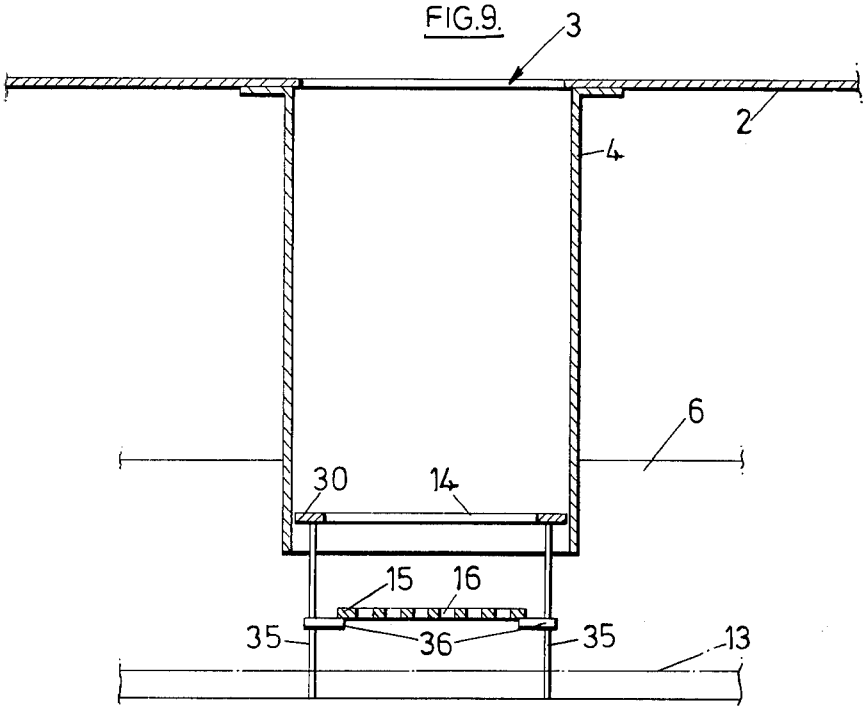
FIG. 9 is a section similar to that of FIG. 1 but illustrates a further alternative form of tube and baffle.
Figure 10:
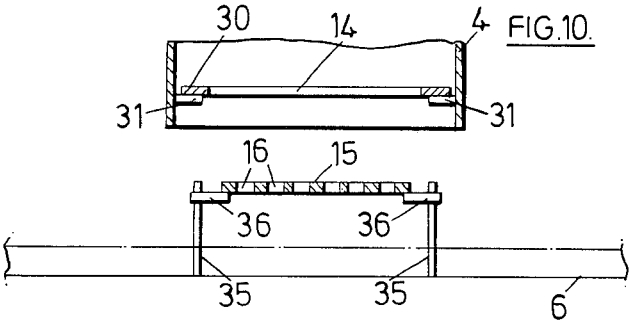
FIg. 10 illustrates a modification to the apparatus of FIG. 9.
Figure 11:
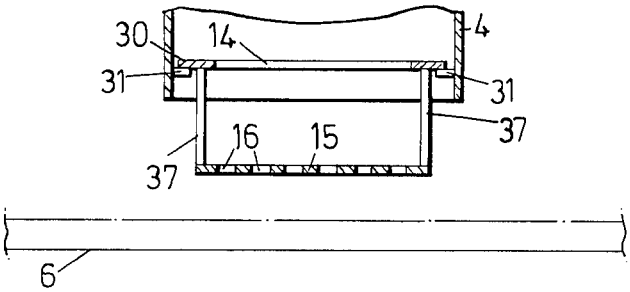
FIG. 11 illustrates another form of modification to the apparatus of FIG. 9.

In the embodiment of FIG. 9 the annular plate 30 and the baffle 15 are supported by legs 35, which may be three in number. The legs 35 are common to the plate and baffle and rest on the bottom of the water-container 1. The baffle 15 rests on projections 36 carried by the legs 35. In the alternative arrangement of FIG. 10 the annular plate 30 rests on projections 31 and the baffle is supported by projections 36 carried by the legs 35, and in the arrangement of FIG. 11 the annular plate 30 rests on projections 31 and is connected to the baffle 15 by struts 37, or the like, so that the baffle 15 depends from the plate 30.

I claim:

1. In a paint-spraying booth of the type including a floor, apparatus for scrubbing paint-laden air, said apparatus comprising a water-container located beneath and spaced from the floor of the booth, air extraction means connected with exhaust ducts which extend lengthwise of and beneath the floor of the booth, at least one tube which opens through and extends downwardly from the floor and has the end thereof nearest the buttom of the water-container disposed above and spaced, when the apparatus is in use, from the level of water in the water-container, and means arranged to cause a flow of water over the floor and into said tube, the end of the tube nearest the bottom of the water-container having associated therewith means defining an air flow-constricting opening which is co-axial with the tube, said opening being substantially parallel to the bottom of the water container, and a baffle positioned between said air flow-constricting opening and the bottom of the water-container and spaced from each thereof in substantially parallel relationship with the air flow-constricting opening and the bottom of the water-container, said baffle being substantially co-axial with the air flow-constricting opening and having a plurality of perforations extending therethrough, said perforations being small as compared with said air flow-constricting opening, the arrangement being such that in use of the apparatus the baffle provides by impingement thereon a first stage separation of paint particles from entraining air, and water in the water-container immediately below the baffle providing by impingement thereon of paint entraining air which passes through the baffle perforations a second stage separation, and an annular curtain of flowing water formed between the end of the tube nearest the bottom of the water-container and the surface of water in the water-container providing a third stage separation by the lateral passage of paint entraining air therethrough.

2. Apparatus according to claim 1, wherein said means defining the air flow-constricting opening comprises the smaller end of a frusto-conical member arranged in continuation of a cylindrical tube, and the baffle is supported by a spider depending from said frusto-conical member.

3. Apparatus according to claim 2, wherein the spider comprises vertically disposed legs and horizontally disposed arms, the arms being provided with cut-out portions on which the baffle rests.

4. Apparatus according to claim 1, wherein said means defining the air flow-constricting opening is formed by an annular plate supported by projections which extend from and into a cylindrical tube near the end of the tube nearest the bottom of the water-container, and the baffle is supported by a plurality of vanes which are spaced apart around the plate and are connected to the plate and to the baffle.

5. Apparatus according to claim 4, wherein each vane includes a downwardly directed portion of arcuate form directed out of the plane of the remainder of the vane.

6. Apparatus according to claim 1, wherein the tube is a cylindrical tube and said means defining the air flow-constricting opening is formed by an annular plate located in the tube at a position near the end of the tube nearest the bottom of the water-container, the plate being supported by legs which stand on the bottom of the water-container and the baffle being supported by projections carried by the legs.

7. Apparatus according to claim 1, wherein the tube is a cylindrical tube and said means defining the air flow-constricting opening is formed by an annular plate which is located in the tube at a position near the end of the tube nearest the bottom of the water-container by projections extending from and into the tube and wherein the baffle is supported by projections carried by legs standing on the bottom of the water-container.

8. Apparatus according to claim 1, wherein the tube is a cylindrical tube and said means defining the air flow-constricting opening is formed by an annular plate which is located in the tube at a position near the end of the tube nearest the bottom of the water-container by projections extending from and into the tube, and wherein the baffle is supported by struts depending from the plate.

* * * * *